US006645004B2

(12) United States Patent
Mudge

(10) Patent No.: US 6,645,004 B2
(45) Date of Patent: Nov. 11, 2003

(54) GEOPHONE KEYWAY TEE PROTECTIVE CASING

(75) Inventor: Dennis L. Mudge, Calgary (CA)

(73) Assignee: Veritas DGC Inc., Houston, TX (US)

( * ) Notice: Subject to any disclaimer, the term of this patent is extended or adjusted under 35 U.S.C. 154(b) by 0 days.

(21) Appl. No.: 10/054,254

(22) Filed: Jan. 22, 2002

(65) Prior Publication Data

US 2003/0139090 A1 Jul. 24, 2003

(51) Int. Cl.[7] ..... H01R 13/52

(52) U.S. Cl. ..... 439/521; 439/892; 439/582; 174/72 C; 174/77 R; 174/167

(58) Field of Search ..... 174/72 R, 167, 174/138 R, 71 R, 72 C, 77 R; 439/701, 582, 521, 596, 892

(56) References Cited

U.S. PATENT DOCUMENTS 3,982,319 A * 9/1976 Bice ..... 174/71 R
4,234,760 A * 11/1980 Lawson ..... 174/71 R
4,538,869 A * 9/1985 Richards ..... 439/596
4,626,059 A * 12/1986 Bohme et al. ..... 439/892
4,652,023 A * 3/1987 Timmons ..... 285/93
4,749,363 A * 6/1988 Luska et al. ..... 439/367
4,778,405 A * 10/1988 Sterken ..... 439/395
4,869,683 A * 9/1989 Nelson ..... 439/892
5,306,870 A * 4/1994 Abat ..... 439/582
5,394,502 A * 2/1995 Caron ..... 174/71 R
6,037,543 A * 3/2000 Nicoli et al. ..... 174/72 R
6,162,085 A * 12/2000 Chugh et al. ..... 439/467
6,217,381 B1 * 4/2001 Kameyama ..... 439/578
6,284,975 B1 * 9/2001 Mccord et al. ..... 174/71 R
6,343,960 B1 * 2/2002 Saito ..... 439/701

* cited by examiner

*Primary Examiner*—Tho D. Ta
*Assistant Examiner*—Briggitte R. Hammond
(74) *Attorney, Agent, or Firm*—Conley Rose, P.C.

(57) ABSTRACT

A protective casing for a three-way electrical connection comprises a cover and two lower pieces. Each lower piece preferably includes a protruding key and a key slot. The two lower pieces mate with one another with the protruding key of each lower piece engaging the key slot of the other lower piece. The keys and slots generally extend a length of the lower pieces and thus mating the lower pieces together includes engaging the keys and slots and sliding one lower piece along an axis relative to the other lower piece. Preferably, the lower pieces are substantially identical. In contrast to conventional tee connection casings, the lower pieces of the preferred embodiment can be mated together without disconnecting any conductors from the three-way electrical connection. Similarly, the protective casing can be removed and replaced with a new casing without disconnecting any electrical connections.

13 Claims, 7 Drawing Sheets

GEOPHONE KEYWAY TEE PROTECTIVE CASING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention generally relates to a protective casing for an electrical connection. More particularly, the invention relates to a protective casing for a tee electrical connection typically found in various applications such as for seismic equipment. Still more particularly, the invention relates to keyed protective casing that can be removed and replaced without disconnection of the electrical connections housed within the tee connection.

2. Background Information

The field of seismology focuses on the use of artificially generated elastic waves to locate subsurface formations which may contain mineral deposits such as hydrocarbons, ores, water, and geothermal reservoirs. Seismology may also be used for archaeological purposes and for obtaining geological information for engineering. Exploration seismology provides data that, when used in conjunction with other available geophysical, borehole, and geological data, can provide information about the structure and distribution of rock types and their contents.

Seismic exploration involves attempting to deduce the subsurface geometry and properties of a portion of land. This typically is accomplished by generating seismic energy via impulse-type explosions or gentler vibrations, detecting the reflected and refracted seismic energy with appropriate detection devices, recording the measurements and processing the recorded information. The detection equipment generally includes a geophone or a plurality of geophones spaced apart in an array. The term "geophone" is used throughout this disclosure to refer to any type of seismic detector. The geophones respond to vibrations from the earth and generate and transmit corresponding electrical signals to recording and processing equipment. An electrical cable couples one geophone to the next in the array.

FIG. 1 shows a schematic drawing of several geophones 10 coupled together by a cable 12. Each geophone connects to the cable 12 at a tee connection 14 (called a "tee" connection because if its general resemblance to the letter "T"). Connection points 14 typically simply comprise electrical conductors and a circuit board that facilitates connecting the conductors together to form the tee connection. Connection points 14, as is true for most of the rest of the seismic detection equipment, are exposed to the elements in the field such as water, wind, and the like. These connections and their associated circuit boards must be protected and, accordingly, a protective covering or housing typically is provided on each tee connection to perform that function. Such a protective covering typically is referred to simply as a "tee." For purposes of this disclosure, the electrical connection is referred to as a "tee connection" and the protective covering is referred to simply as a "tee."

A conventional tee is depicted in FIG. 2 and typically comprises two pieces 16 and 18 which are typically attached together with screws or similar fasteners to protect the connection. To install such a tee, the electrical cable 20 to the geophone 10 is inserted upward and through an opening in the bottom tee half 18. Then, the conductors in cable 20 are soldered to a circuit board in the tee connection point 14 to which the ends of cable 12 are also soldered. After the connections are soldered, the top tee half 16 is positioned over the lower half 18 and the two halves are placed together and attached by screws.

Although generally satisfactory, there is a significant disadvantage to the conventional two-piece tee shown in FIG. 2. If the bottom tee half 18 breaks, or for some other reason needs replacement, a labor intensive and time consuming task is necessary to replace the bottom tee half. To remove the bottom tee half, the two tee halves 16, 18 must first be disconnected from each other. Then, the electrical connections corresponding to cable 20 must be desoldered. Once cable 20 is disconnected from connection point 14, the broken bottom tee half 18 can be removed and replaced with a new piece. Then, the conductors associated with geophone cable 20 must be resoldered. Finally, the top half 16 must be reattached to the lower half. This entire process can take upwards of 15 to 20 minutes. On a seismic site having hundreds or thousands of tees, this process can be very time consuming and costly. Further, each time a solder joint is desoldered and resoldered, the mechanical and electrical integrity of the connection is diminished.

Accordingly, a solution to the aforementioned problem is needed. Such a solution would preferably permit quick removal and replacement of a tee and avoid the problems associated with desoldering and resoldering electrical connections.

BRIEF SUMMARY OF THE PREFERRED EMBODIMENTS OF THE INVENTION

The problems noted above are solved in large part by a three-piece keyway tee that comprises a cover and two lower pieces. Each lower piece preferably includes a protruding key and a key slot. The two lower pieces mate with one another, with the protruding key of each lower piece engaging the key slot of the other lower piece. The keys and slots preferably extend through an entire length of the lower pieces. In such an embodiment, mating the lower pieces together includes engaging the keys and slots and sliding one lower piece along an axis relative to the other lower piece. Preferably, the lower pieces are substantially identical.

According to one preferred embodiment, each lower piece has a groove along its length, such that when mated together, the grooves of the lower pieces align generally forming a passageway through which the geophone cable can extend up to the connection point 14. As such, the lower pieces surround the geophone cable when mated together. Thus, in contrast to conventional tee connection casings, the lower pieces of the preferred embodiment can be mated together without disconnecting any conductors from a three-way electrical tee connection. Similarly, the keyway tee can be removed and replaced with a new keyway tee without disconnecting any electrical connections. These and other advantages and benefits will become apparent upon reviewing the following disclosure.

BRIEF DESCRIPTION OF THE DRAWINGS

For a detailed description of the preferred embodiments of the invention, reference will now be made to the accompanying drawings in which.

NOTATION AND NOMENCLATURE

Certain terms are used throughout the following description and claims to refer to particular system components. As one skilled in the art will appreciate, companies and individuals may refer to a component and sub-components by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either a direct or indirect electrical connection. Thus, if a first part couples to a second part, that connection may be either a direct connection or an indirect connection via other parts and connections. To the extent that any term is not specially defined in this specification, the intent is that the term is to be given its plain and ordinary meaning.

DETAILED DESCRIPTION OF THE PREFERRED EMBODIMENTS

The following description is directed to a protective casing for an electrical connection. The scope of the disclosure and the claims which follow are not limited to electrical connections and cables employed in seismic equipment systems. Broadly, the embodiments described herein pertain to protecting any type of three-way electrical connection regardless of overall functionality of the associated equipment.

Figure 1:
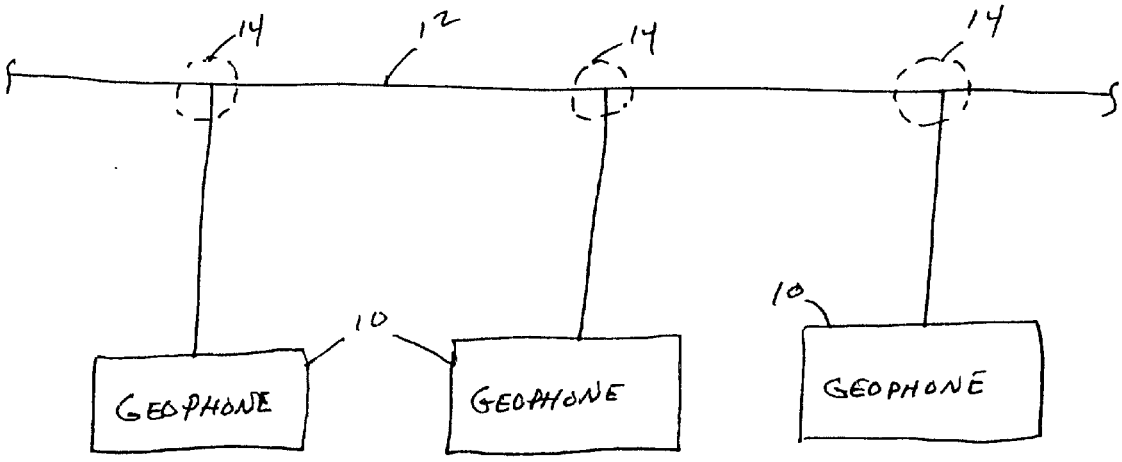
FIG. 1 shows a schematic layout of a plurality of geophones showing the tee connections associated with each geophone.
Figure 2:
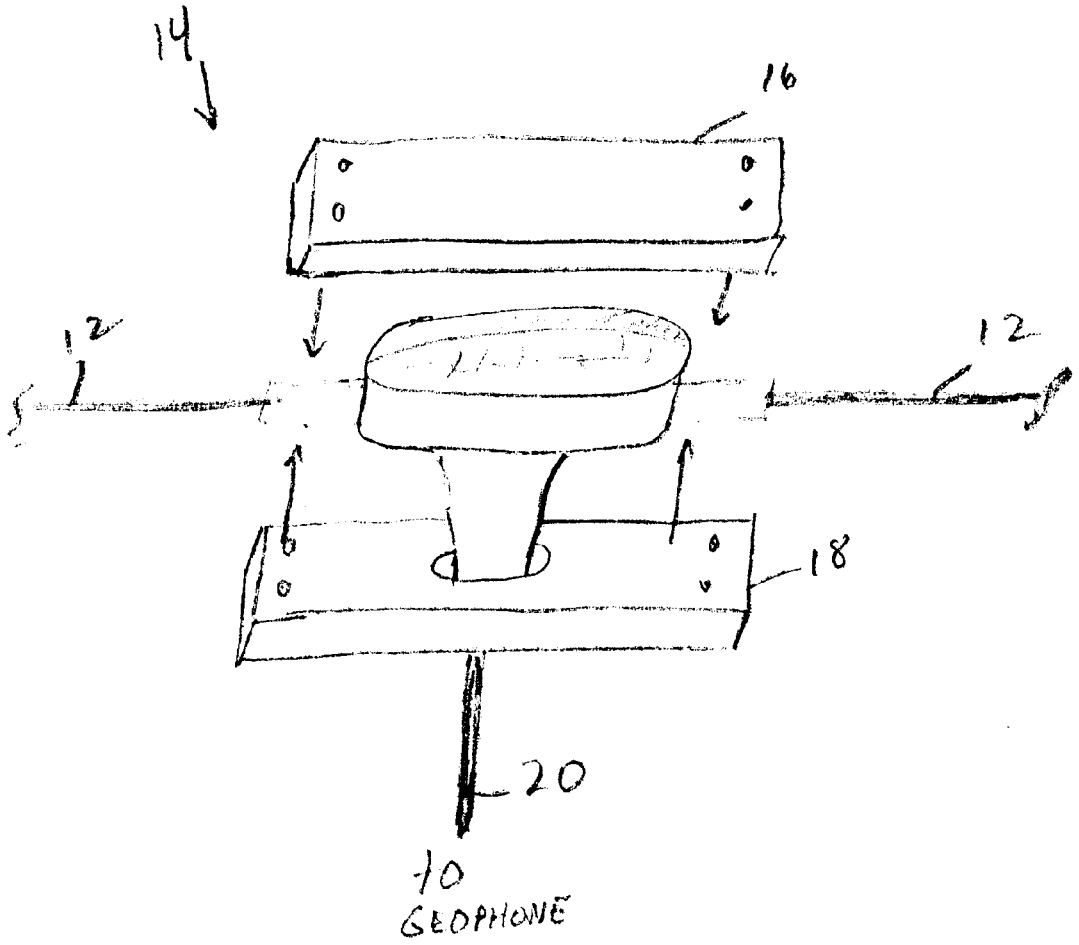
FIG-2 (PRIOR ART)
FIG. 2 shows a conventional tee and illustrates the disadvantage associated with it when having to remove and replace the tee.
Figure 3:
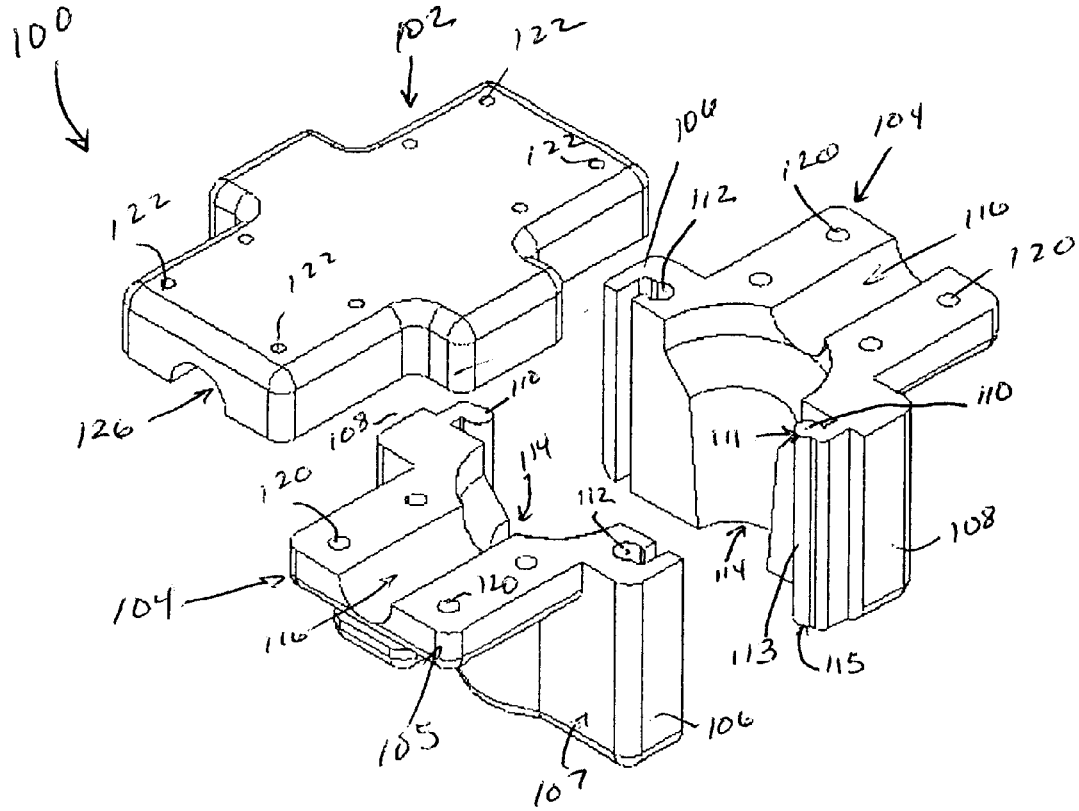
FIG. 3 shows an exploded perspective view of a keyway tee in accordance with a preferred embodiment of the invention.

Referring now to FIG. 3, a preferred embodiment of a tee connection protective casing 100 is shown. As will be explained below, the protective casing 100 is keyed and accordingly is referred to as a "keyway tee." As shown, the preferred embodiment of keyway tee 100 generally comprises three components: an upper piece 102 and two lower pieces 104. The lower pieces 104 mate together in a subcombination and the upper piece 102 mates to the assembled subcombination of the lower pieces. The upper piece 102 generally comprises a cover for the keyway tee.

As can be seen in FIG. 3, the lower pieces 104 of the keyway tee 100 are identical to each other, although the lower pieces do not have to be identical (i.e., non-identical lower pieces 104 may be employed in alternative embodiments of the invention and fall within this disclosure). Identical lower pieces 104 are preferred, however, to minimize the complexity and the cost associated with manufacturing the keyway tee 100. By having identical lower pieces 104, the keyway tee 100 of the preferred embodiment comprises only two different pieces—over 102 and lower pieces 104 (albeit two instances of the lower piece). Further, installation of the keyway tee 100 is simplified in that if one of the lower pieces 104 needs replacement, the person performing the replacement need not hassle with keeping track of three different parts which would be the case if the lower pieces 104 were not identical. Inventory of replacement parts also is simplified.

Each lower piece 104 and cover 102 preferably comprise a single part made of plastic or other material that suitably protects the electrical wiring and connections contained in tee 100. Each lower piece 104, as well as cover 102, may be injection molded or manufactured in accordance with other known manufacturing techniques. Each lower piece 104 is preferably generally L-shaped as shown, although other shapes can be used in the implementation of the keyway tee. The embodiment of the lower piece 104 shown in FIG. 3 includes a horizontal member 105 and a vertical member 107 generally at an orthogonal angle to member 105. As noted above, members 105, 107 may be extensions from a single piece of injection molded material or can be separate pieces mated or connected together in some suitable fashion (e.g., adhesive, screws, welding, etc.). Each lower piece 104 includes a groove 116 through the horizontal member 105 and another groove 114 vertically down the vertical member 107. When the two lower pieces 104 are mated together, the vertical grooves 114 generally align, forming an approximately circular or elliptical passageway.

Figure 4A:
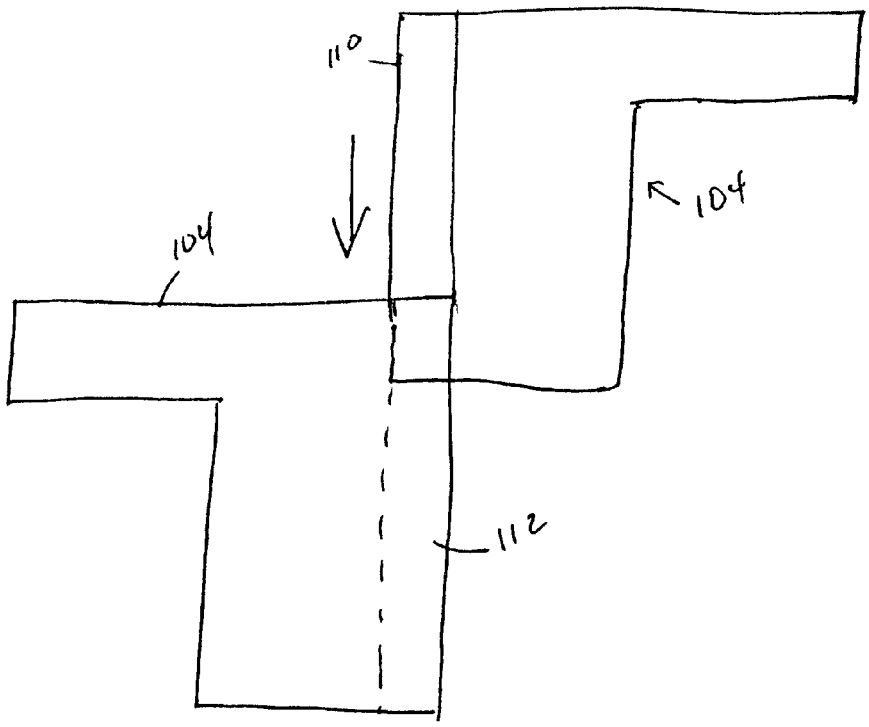
FIGS. 4*a* and 4*b* illustrate how two lower pieces of the keyway tee are mated together.
Figure 4B:
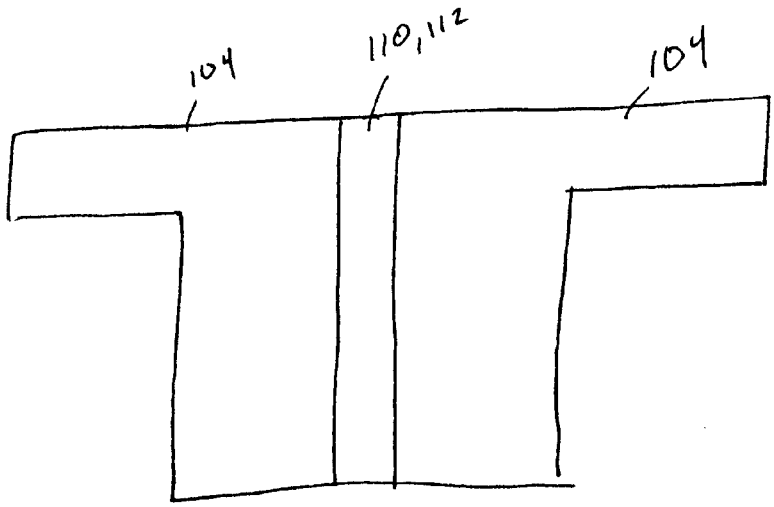
Figure 5:
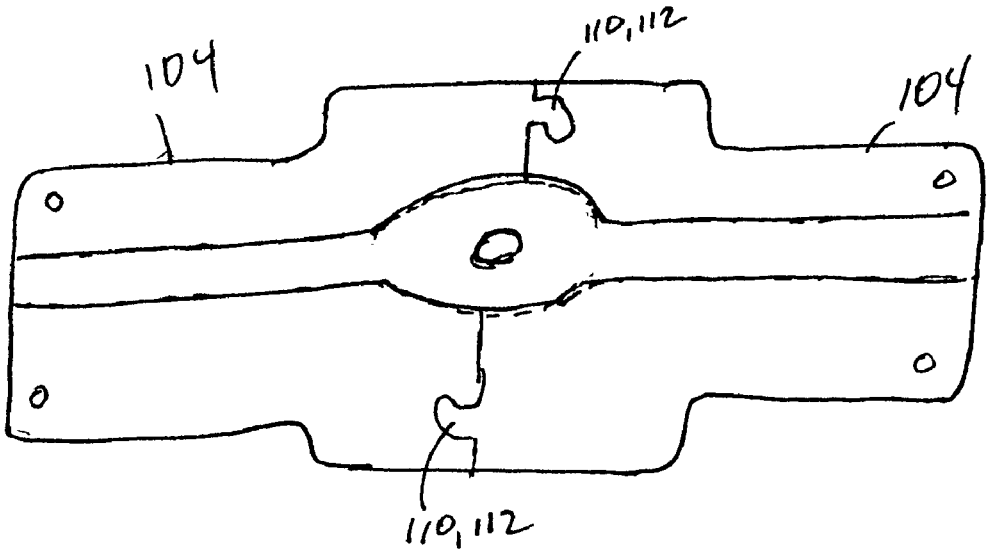
FIG. 5 shows a top view of the lower pieces of the keyway tee mated together.

In accordance with the preferred embodiment, each lower piece 104 comprises a protruding key 110 and a corresponding key slot 112. Each key includes an engaging face 113 which engages a corresponding slot 112. Each lower piece 104 preferably includes a protruding key 110 formed at one side 108 and a key slot 112 formed at the opposite side 106. The cross-sectional shape of the protruding key 110 and corresponding key slot 112 is generally rounded (e.g. circular) with preferably parallel engaging faces 113, although the shape can be varied as desired. For example, the engaging faces 113 comprising the key and slot can be tapered (not shown) if desired from an upper end 111 to the opposite end 115. The two pieces 104 are mated together by sliding one piece 104 with respect to the other piece with the protruding keys 110 in the key slots 112 as shown in FIGS. 4*a* and 4*b*. In FIG. 4*a*, the protruding key 110 of the right hand lower piece 104 is engaged with the key slot 112 of the left hand lower piece and slid down in the direction of the arrow until the ends of the two pieces are flush as in FIG. 4*b*. The keys 110 and slots 112 preferably are formed down the entire length L of the lower piece 104 permitting the two lower pieces to be engaged with each other starting from either end—the right hand piece 104 slidingly engages the left hand piece 104 as shown in FIG. 4*a* or the left hand piece slidingly engages the right hand piece. FIG. 5 shows a top view of two lower pieces 104 mated together.

Figure 6:
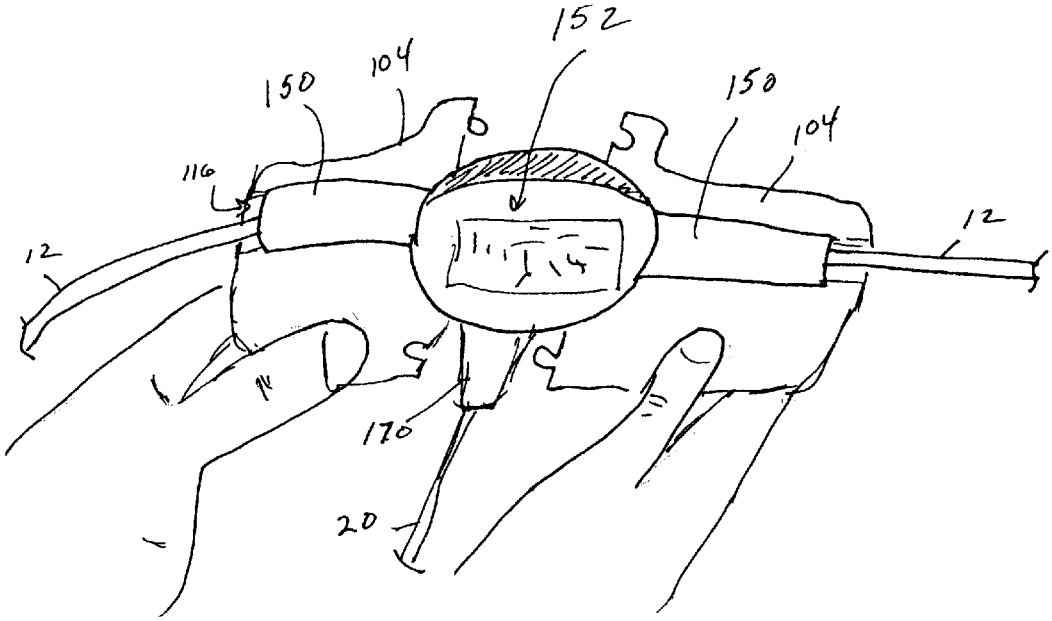
FIG. 6 illustrates an intermediate step during the installation of the keyway tee.

An advantage of the preferred keyway tee 100 is that it can be removed and/or installed without disconnecting any of the electrical connections as was the case with conventional tee casings. This advantage results from the lower portion of the tee comprising two separate pieces 104 rather than a single piece as with prior casings. Accordingly, as illustrated in FIG. 6, a person, such as a technician in the field who often must perform maintenance in adverse conditions, can mate the lower pieces 104 together without disconnecting cable 20, which couples to the geophone (not shown in FIG. 6), or cables 12 which couple to other tee connections. Once the two lower pieces 104 are mated together as described above, the cover 102 (FIG. 3) is attached to the assembled combination of lower pieces.

Figure 7:
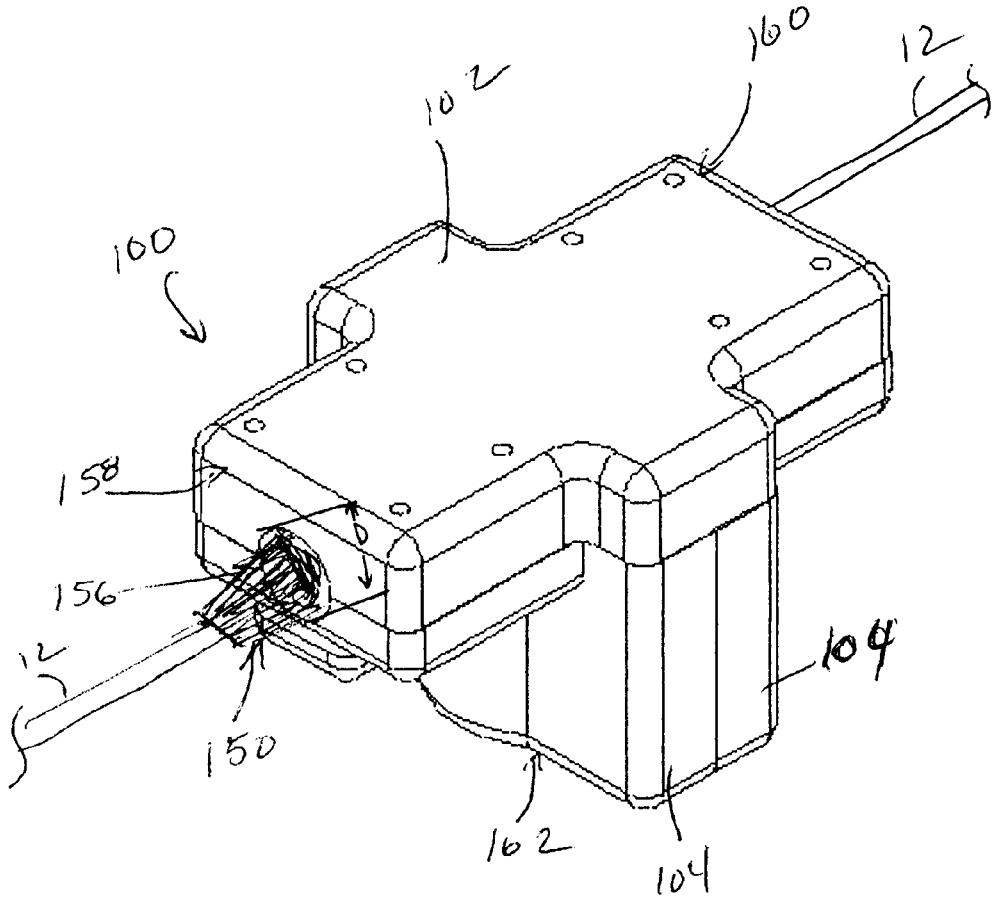
FIG. 7 shows a perspective view of a fully assembled keyway tee.

Referring still to FIG. 6, protective coverings 150 surround electrical cables 12. These coverings preferably are made from rubber, nylon, flexible plastic or other suitable material and protect against the intrusion of contaminants (e.g., water, dirt, etc.) into the inner region 152 containing the electrical connections. The keyway tee 100 of the preferred embodiment performs a sealing function to aid in preventing intrusion of such contaminants. The rubber coverings 150 rest in the grooves 116 in the lower pieces 104 when the lower pieces mate together. As shown in FIG. 3, cover 102 includes a corresponding groove 126. When the cover 102 is mated to the lower pieces 104, the grooves 116 and 126 generally align and form, in cross section, an approximately circular or elliptical passage. This is shown in FIG. 7 which depicts an assembled keyway tee 100. The grooves in the upper and lower pieces 102, 104 form a circular or elliptical opening 156 in either end 158, 160 of the tee 100. Although the shape of the resulting opening 156 is generally circular or elliptical, the shape can be varied as desired (e.g., square, rectangular, etc.). The diameter D of the opening 156 preferably is smaller than the diameter of the covering 150 when in its uncompressed (i.e., natural) state. As the covering 102 is mated with the lower pieces 104, the covering 150 is compressed under the pressure caused by the cover 102 and lower pieces 104. Compressing the covering 150 helps to seal both ends of the keyway tee 100.

As can be seen in FIG. 6, a covering 160 also is provided on the cable 20 which extends to the geophone. That covering resides within the opening 114 (FIG. 3) formed between the lower pieces as they are mated together. Covering 170 surrounds cable 20. Opening 114 also preferably is smaller than the diameter of the covering 170 thereby causing the covering 170 to be compressed as the lower pieces 104 are mated together. Accordingly, the opening in the lower end 162 of the keyway tee 100 from which cable 20 extends is sealed protecting the tee connection from contaminants. Once lower pieces 104 are mated together, the cover 102 is mated to the assembled combination of lower pieces to complete the tee casing assembly via screws (not shown) through holes 120 and 122.

The preferred embodiment of the keyway tee 100 advantageously permits a tee to be easily and quickly removed and replaced in the field. As such, labor time and costs associated with maintenance of these tee connections in the field are dramatically reduced. The electrical connections being protected by the keyway tee do not need to be desoldered or otherwise disconnected or interfered with any way. As such, the integrity of the electrical connections is not diminished by replacement of the protective tee covering.

The above discussion is meant to be illustrative of the principles and various embodiments of the present invention. Numerous variations and modifications will become apparent to those skilled in the art once the above disclosure is fully appreciated. For example, although a three-piece keyway tee is shown in the Figures and described above, embodiments having more than three pieces are also within the scope of this disclosure. It is intended that the following claims be interpreted to embrace all such variations and modifications.

What is claimed is:

1. A protective casing for an electrical tee connection, comprising:

a pair of lower pieces, each lower piece having a protruding key and a key slot corresponding to the protruding key, each lower piece having two members formed at orthogonal angles to each other, each member having a groove in which an electrical conductor resides when said protective casing is assembled; and a covering that mates with said lower pieces;

said lower pieces mate together with a protruding key from each lower piece engaged in the corresponding key slot in the other lower piece.

2. The protective casing of claim 1 wherein each pair of protruding key and corresponding key slot is rounded in cross section.

3. The protective casing of claim 1 wherein each pair of protruding key and corresponding key slot extend throughout the entire length of the casing.

4. The protective casing of claim 1 wherein said lower pieces are mated together by sliding one piece relative to the other piece.

5. The protective casing of claim 1 further including protective coverings located in the grooves in said lower pieces.

6. The protective casing of claim 1 wherein the pair of lower pieces mate together around one or more electrical conductors without disconnecting the electrical conductors.

7. The protective casing of claim 6 wherein the pair of lower pieces can be disassembled without disconnecting the electrical conductors.

8. The protective casing of claim 1 wherein the lower pieces are substantially identical.

9. The protective casing of claim 8 wherein the protruding key and a corresponding key slot are formed on opposite sides of each lower piece.

10. A method of protecting an electrical connection in which three electrical cables are connected together, comprising:

(a) mating together two protective portions around at least one of said electrical cables while all three electrical cables are connected, each protective portion having two members formed at orthogonal angles to each other; and (b) mating a cover to said two protective portions while all three electrical cables are connected.

11. The method of claim 10 wherein (a) includes keying one protective portion into the other protection portion.

12. The method of claim 10 wherein (a) includes engaging and sliding one protective portion relative to the other protective portion.

13. The method of claim 10 wherein the two protective portions are substantially identical.

* * * * *